US005349837A

United States Patent [19]

Halasz et al.

[11] Patent Number: 5,349,837

[45] Date of Patent: Sep. 27, 1994

[54] METHOD AND APPARATUS FOR PROCESSING CONTAINERS

[76] Inventors: Andrew Halasz, 3007 Springbrook Rd., Crystal Lake, Ill. 60012; Sylvan Praturlon, 4822 S. Ellis, Chicago, Ill. 60615

[21] Appl. No.: 730,794

[22] PCT Filed: Jan. 26, 1990

[86] PCT No.: PCT/US90/00451

§ 371 Date: Jul. 24, 1991

§ 102(e) Date: Jul. 24, 1991

[87] PCT Pub. No.: WO91/11275

PCT Pub. Date: Aug. 8, 1991

Related U.S. Application Data

[60] Continuation-in-part of Ser. No. 351,769, May 12, 1989, Pat. No. Des. 332,750, which is a continuation-in-part of Ser. No. 945,314, Dec. 22, 1986, Pat. No. Des. 306,972, which is a division of Ser. No. 594,610, Mar. 24, 1984, Pat. No. Des. 290,688, which is a continuation-in-part of Ser. No. 523,514, Aug. 15, 1983, Pat. No. Des. 283,011.

[51] Int. Cl.[5] ..... B21D 51/26

[52] U.S. Cl. ..... 72/94; 72/105

[58] Field of Search ..... 72/94, 105, 106, 110, 72/123

[56] References Cited

U.S. PATENT DOCUMENTS 4,316,375 2/1982 Lee, Jr. ..... 72/105

4,578,976 4/1986 Shulski et al. ..... 72/105

4,885,924 12/1989 Claydon et al. ..... 72/109

FOREIGN PATENT DOCUMENTS 13710 4/1974 Japan ..... 72/106

*Primary Examiner*—Lowell A. Larson

*Attorney, Agent, or Firm*—Wallenstein, Wagner & Hattis, Ltd.

[57] ABSTRACT

A drawn and ironed container (C) that includes a cylindrical side wall, a smoothly-tapered neck (134) with an open end and an integral bottom wall (137) at the opposite end has a plurality of inwardly-deformed panel segments (130) located in the side wall between adjacent arcuate segments (132) with the panel defining generally chordal bottom walls for the panel segments. The container is formed using a multi-station processing apparatus that consists of a plurality of identical stations (30) located around the periphery of a rotating turret (26). Each station includes a support mandrel (50), a container loading means (52, 53) and an impression mandrel (54), with the impression mandrel being pivoted into and out of pressure engagement with the support mandrel to deform the side wall of the container. The support mandrel has a cylindrical peripheral surface (102) that conforms to the inner diameter of the container side wall and has circumferentially-spaced, axially-extending pockets (104. The pockets have sharp opposite edges (108*a*) that cooperate with the impression mandrel to produce the panel segments in the side wall.

27 Claims, 7 Drawing Sheets

20
72
64
66
80
114
116
62
110
24
60
30
112
26
49
42
46
34
36
32
44
48
38
40

FIG. 6
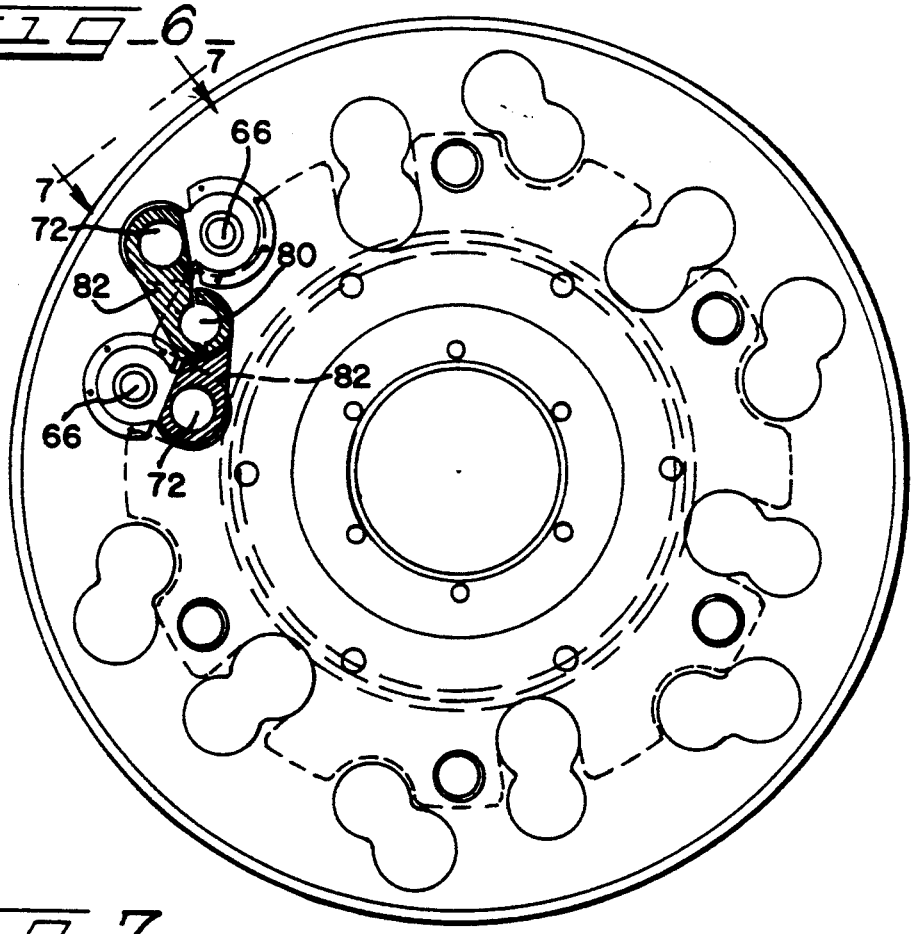
FIG. 7
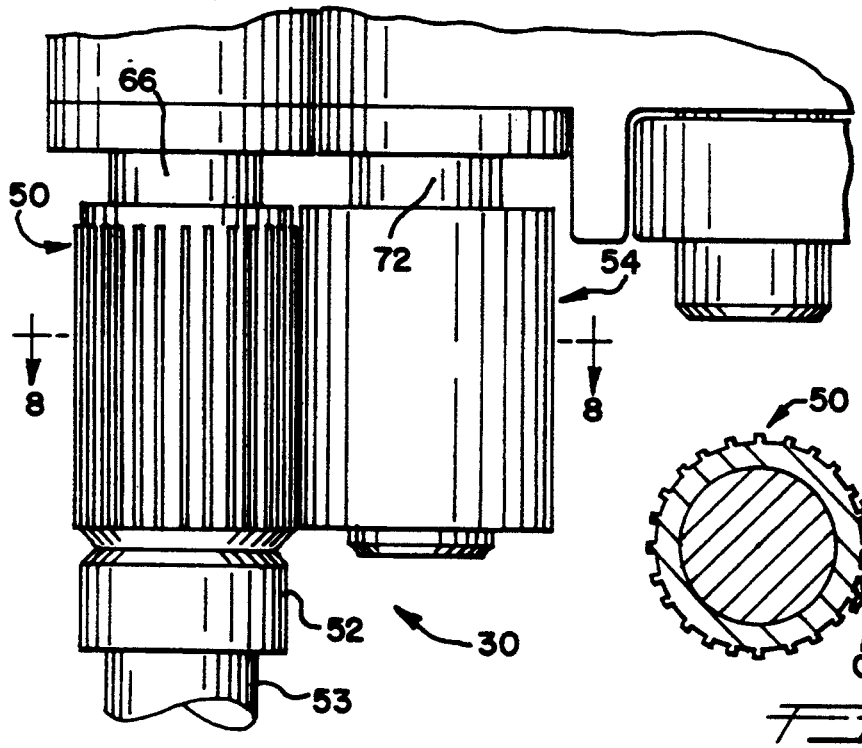
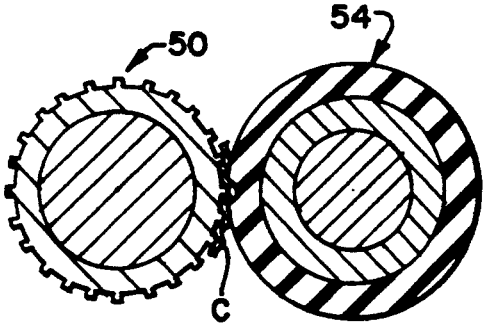
FIG. 8

METHOD AND APPARATUS FOR PROCESSING CONTAINERS

RELATED APPLICATIONS

This application is a continuation-in-part application of Ser. No. 351,769 filed May 12, 1989, now U.S. Pat. No. Des. 332,750 which is a continuation-in-part application of Ser. No. 945,314, filed Dec. 22, 1986, (U.S. Pat. No. Des. 306,972, issued Apr. 3, 1990) which is a divisional application of Ser. No. 594,610, filed Mar. 24, 1984 (U.S. Pat. No. Des. 290,688, issued Jul. 7, 1987) which in turn is a continuation-in-part application of Ser. No. 523,514, filed Aug. 15, 1983 (U.S. Pat. No. Des. 283,011, issued Mar. 18, 1986).

TECHNICAL FIELD

This invention relates generally to two-piece container constructions, and more particularly to a method and apparatus for processing such containers to increase the strength thereof, as well as improve the appearance.

BACKGROUND PRIOR ART

Two-piece cans are the most common type of metal container used in the beer and beverage industry, as well as for aerosol and food packaging. The two-piece container consists of a unitary body, including a side wall open at one end with an integral end wall at the other end. The integral end wall is usually formed to a domed-shaped configuration to increase the overall strength of the container. An annular portion is usually formed to a special configuration between the center dome panel of the bottom wall and the side wall that defines a reduced diameter support for the container and also provides a nesting feature for nesting with the end of an adjacent container, which is seamed to the open end thereof.

An exemplary bottom profile for a drawn and ironed container that has achieved a remarkable degree of commercial success is disclosed in U.S. Pat. No. 4,685,582. The container disclosed therein also includes an upper end portion that has a reduced neck so that a second end panel or end having a smaller diameter can be utilized to enclose the open-ended drawn and ironed container.

In most cases, containers that are used for beer and carbonated beverages are formed from a flat aluminum disc to an outside diameter of 2-11/16th inch (referred to as a "211-container") and the upper open end is reduced in diameter to form a 209-neck (2-9/16th inch) or any other smaller diameter, such as a 207½-neck, a 206-neck, and even a 204-neck or smaller so that smaller diameter ends can be utilized in the finished package.

An important competitive objective in the packaging industry is to reduce the total can weight as much as possible, while maintaining its strength and performance, in accordance with industry requirements. For pressurized contents, such as soft drinks or beer, the integral bottom end wall of the container usually has the same metal thickness gauge as the initial disc and the side wall is reduced through a drawing and ironing process to a thickness approaching one-third of the thickness of the original metal disc. Accordingly, to minimize overall weight, the can top or end panel that forms the second piece of the two-piece can is made as diametrically small as possible, while still maintaining the structural integrity of the container, the functionality thereof, and an aesthetically-pleasing appearance.

In the manufacture of containers of this type, a sheet of stock material of predetermined thickness is fed to a cupping press, wherein circular discs are cut from the stock material and are transformed into cups having a diameter which is considerably larger than the ultimate diameter of the finished container.

The preformed cups are then transferred to a container-forming apparatus, commonly referred to as a "bodymaker" wherein the cup is aligned with a punch carried on a reciprocable ram which cooperates with a plurality of spaced ironing dies and a doming mechanism located at the end of the path of the punch. During the forming process, the punch initially cooperates with a redraw assembly in which the shallow cup is redrawn to a smaller diameter that has an internal diameter approximately equal to the internal diameter of the ultimately-finished container and a height that is greater than the height of the original cup.

Each cup then passes through a series of ironing dies having progressively reduced diameters so that the side wall of the container is progressively reduced in thickness, while the height of the container increases. At the end of the stroke for the punch or ram, the end of the container is forced into a predetermined configuration to form an integral end wall that has a central inwardly-domed panel and a specially-configured peripheral annular bead or support portion. The drawn and ironed container is then trimmed to a selected height and coated and labeled, and a reduced tapered neck is produced on the open end.

To produce a container that can be price competitive and yet meet the rigid industry requirements, particularly for pressurized contents, such as beer and carbonated beverages, the Assignee of the present invention has developed a die necking operation for sequentially reducing the upper open end of the container to a smooth die neck configuration. This is done through a plurality of steps until the desired reduction for an end, such as a 206- or 204-end, is achieved. This process is disclosed in U.S. Pat. No. 4,774,839, incorporated herein by reference. A container of the type having a bottom profile, such as disclosed in U.S. Pat. No. 4,685,582, and a smooth die neck configuration illustrated in the above-referenced patent has increased strength characteristics and the overall aesthetic appearance has been enhanced.

In order to further enhance the overall appearance of the two-piece drawn and ironed container, it has also been proposed to deform the container side wall to produce a fluted appearance, such as disclosed in U.S. Pat. Nos. Des. 283,011 and DES 290,688.

SUMMARY OF THE INVENTION

According to the present invention, a unique drawn and ironed container has been developed which can be formed from a minimum amount of stock material and yet be capable of meeting all of the strenuous requirements for such containers that are particularly adapted for use in the beer and beverage industry.

More specifically, the container of the present invention can be formed from a stock material, preferably an aluminum flat disc having a thickness of less than 0.0120 inch and meet the minimum crush and buckle requirements of 250 pounds and 90 psi, respectively.

The container, which is formed from a flat metal disc, preferably aluminum, includes a bottom wall that has a thickness substantially equal to the thickness of the stock material and a reduced side wall thickness that is on the order of ⅓ the thickness of the stock material, with the bottom wall having a central inwardly-domed panel connected to the side wall through a countersink that has outer and inner, generally flat, substantially vertical walls.

The side wall of the container has a plurality of circumferentially-spaced, axially-extending, inwardly-deformed panel segments. The panel segments are formed between substantially axial lands or arcuate segments that are co-terminus with the remainder of the side wall and opposite ends of the panel segments merge smoothly with the side wall adjacent opposite ends thereof. The panel segments are located within the confines of the side wall between the juncture of the countersink at the bottom and the juncture of the inwardly-tapered neck at the upper open end of the container.

According to one aspect of the invention, the panel segments are formed in the side wall in a continuous process through an apparatus that includes a turret mounted for fixed rotation on a support column. The turret has a plurality of identical deforming stations circumferentially spaced around the periphery thereof. Each deforming station includes a support mandrel supported for rotation about a fixed axis on the turret and has an axially-aligned loading mechanism for loading the container onto the support mandrel. Each station also incorporates a compressible impression mandrel that is mounted on the turret adjacent the support mandrel for movement into and out of pressure contacting engagement with the support mandrel to deform a container therebetween.

According to another aspect of the invention, a pair of adjacent impression mandrels are mounted on a common support shaft. The support shaft is rotated on the fixed axis on the turret to simultaneously pivot two impression mandrels into and out of pressure contacting engagement with an associated support mandrel.

The support mandrel has a plurality of circumferentially-spaced pockets formed between adjacent lands. Each pocket has opposite edges which are defined by generally radial walls that extend inwardly from the outer wall and terminate in a bottom wall that defines a generally chordal segment between adjacent lands. The opposite ends of the bottom wall of the respective pockets are smoothly tapered to merge with the periphery of the support mandrel. This defines a smooth transition between the bottom wall of the pocket and the periphery of the mandrel.

Preferably, the pockets are positioned on the mandrel such that the panel segments are formed in the side wall of the container between the juncture of the bottom wall and the tapered neck at opposite ends of the side wall.

According to one further aspect of the present invention, the support mandrel and impression mandrel at each station are driven in synchronized relation. This defines a common speed for the peripheral surfaces of the respective mandrels. The drive mechanism for the impression mandrel incorporates a frictional drive arrangement to accommodate any required differences in peripheral velocity because of compression of the periphery of the impression mandrel during pressure contact with the support mandrel.

In the method of operating the apparatus for deforming the container having the superior characteristics described above, containers are sequentially fed from a source to respective support or loading means at each of the stations on the turret and are cammed onto the respective support mandrels by suitable cams interposed between the support and the turret. Also, the respective impression mandrels are pivoted through a suitable cam mechanism to produce pressure contact engagement between the impression mandrel and associated support mandrel at each of the stations while both mandrels are continuously rotated through a common drive.

A control slippage is provided between the common drive and each impression mandrel to accommodate compression of the impression mandrel.

BRIEF DESCRIPTION OF DRAWINGS

FIG. 6 is a schematic top plan view of the various stations of the apparatus shown in FIG. 1 showing the relationship of the impression mandrels in association with a pair of forming or support mandrels at one processing station;

FIG. 7 is a fragmentary side view showing the details of one of the processing stations as viewed along line 7—7 of FIG. 6;

FIG. 8 is a cross-sectional view as viewed along 8—8 of FIG. 7, with a section of a can wall showing the co-action of the impression mandrel and support mandrel;

DETAILED DESCRIPTION

Figure 1:
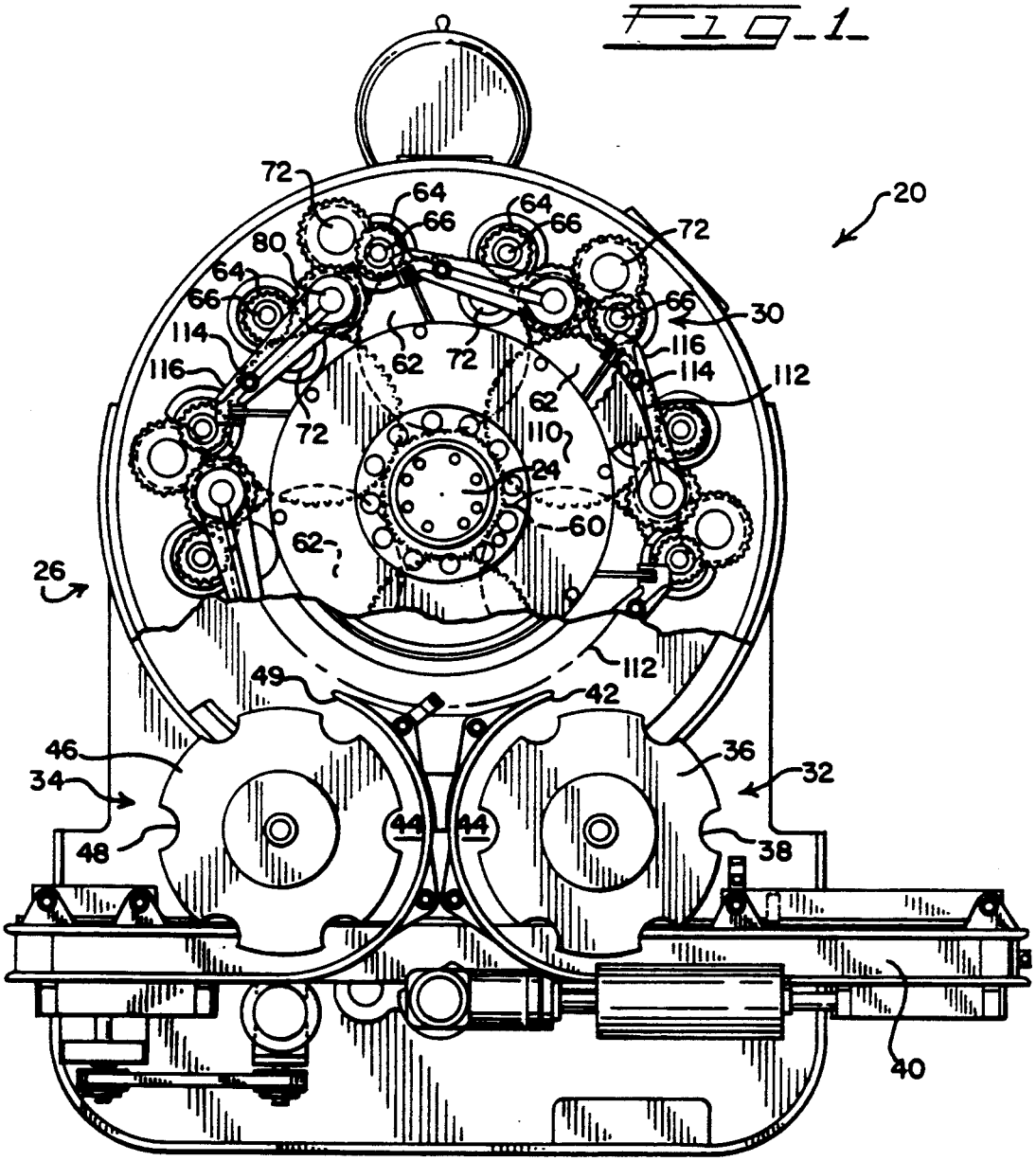
FIG. 1 is a plan top view with parts thereof broken away showing the processing apparatus constructed in accordance with the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to embodiments illustrated.

FIG. 1 of the drawings discloses a container-processing apparatus, generally designated by reference numeral 20, consisting of a base 22 (FIG. 2) that has a center upstanding post or column 24 which supports a rotatable turret 26. The turret 26 is rotated about the center support means or column 24 through a drive means 28 mounted on the base 22. The turret 26 has a plurality of substantially identical processing stations 30 mounted on the periphery thereof, there being twelve such stations illustrated in FIGS. 1 and 2, but the number thereof can readily be increased or decreased to correlate with a manufacturing facility.

Conventional two-piece drawn and ironed containers prior to necking and flanging are delivered to the processing apparatus 20 through an infeed mechanism 32 and are removed from the processing apparatus through a discharge mechanism 34. The infeed mechanism 32 includes a conventional star wheel 36 that has a plurality of peripheral pockets 38 for receiving containers from a continuously-moving conveyor 40 for delivery to each of the processing stations 30. Preferably, the feed apparatus 32 includes a guide rail 42 which guides the containers along a stationary plate 44 to be picked up at each of the stations 30, as will be described later.

Likewise, the discharge mechanism 34 includes a second star wheel 46 that again has pockets 48 for receipt of the processed or fluted containers from each of the stations 34 for ultimate delivery to the continuously-moving conveyor 40 where they will be transported for further processing. The discharge mechanism 34 again has an arcuate guide plate 49, as shown in FIG. 1. The processed containers are withdrawn from processing stations 30 by star wheel 46 and are guided along support plates 44 to conveyor 40.

Figure 2:
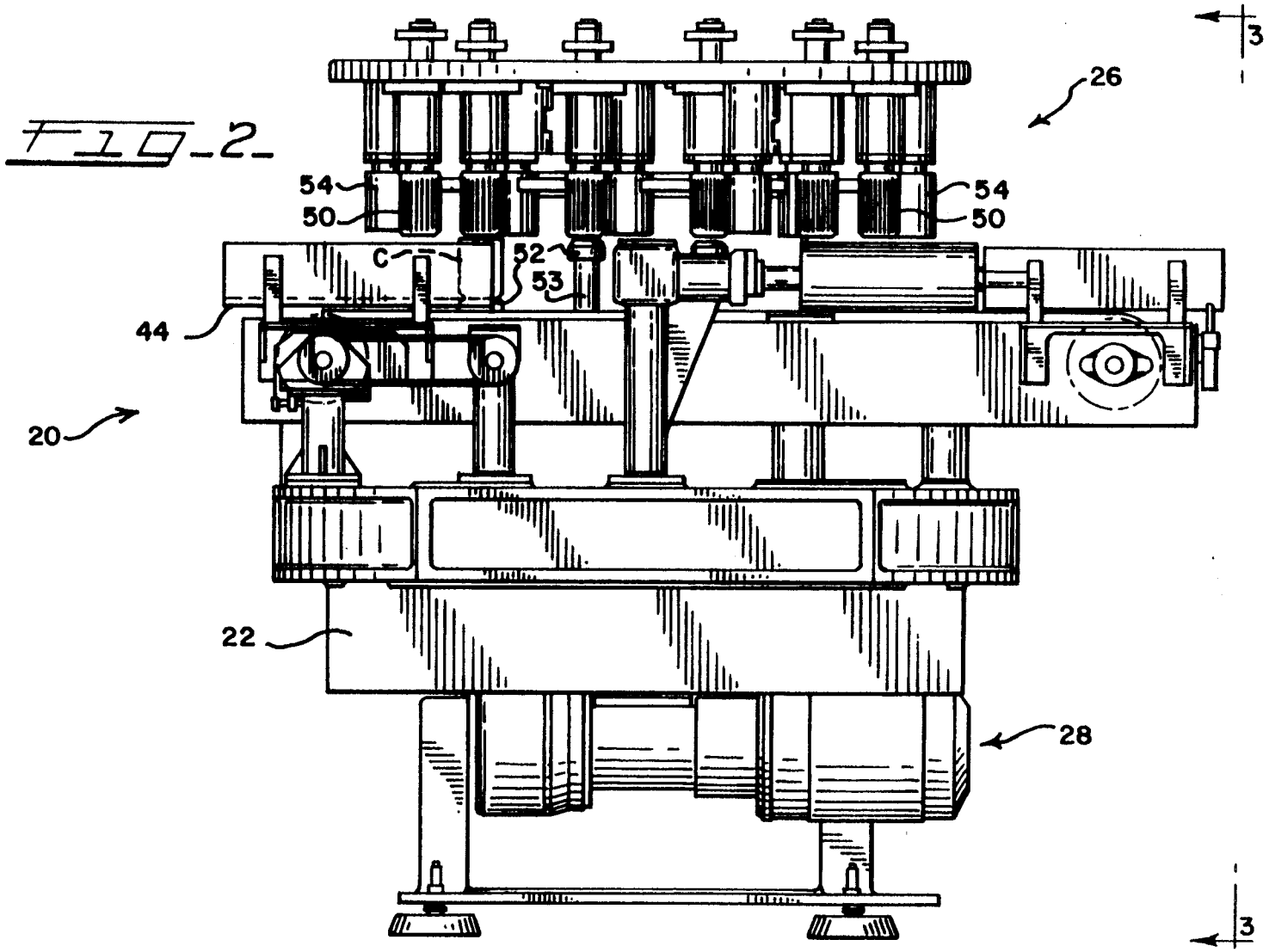
FIG. 2 is a side elevation view of the apparatus shown in down FIG. 1.
Figure 3:
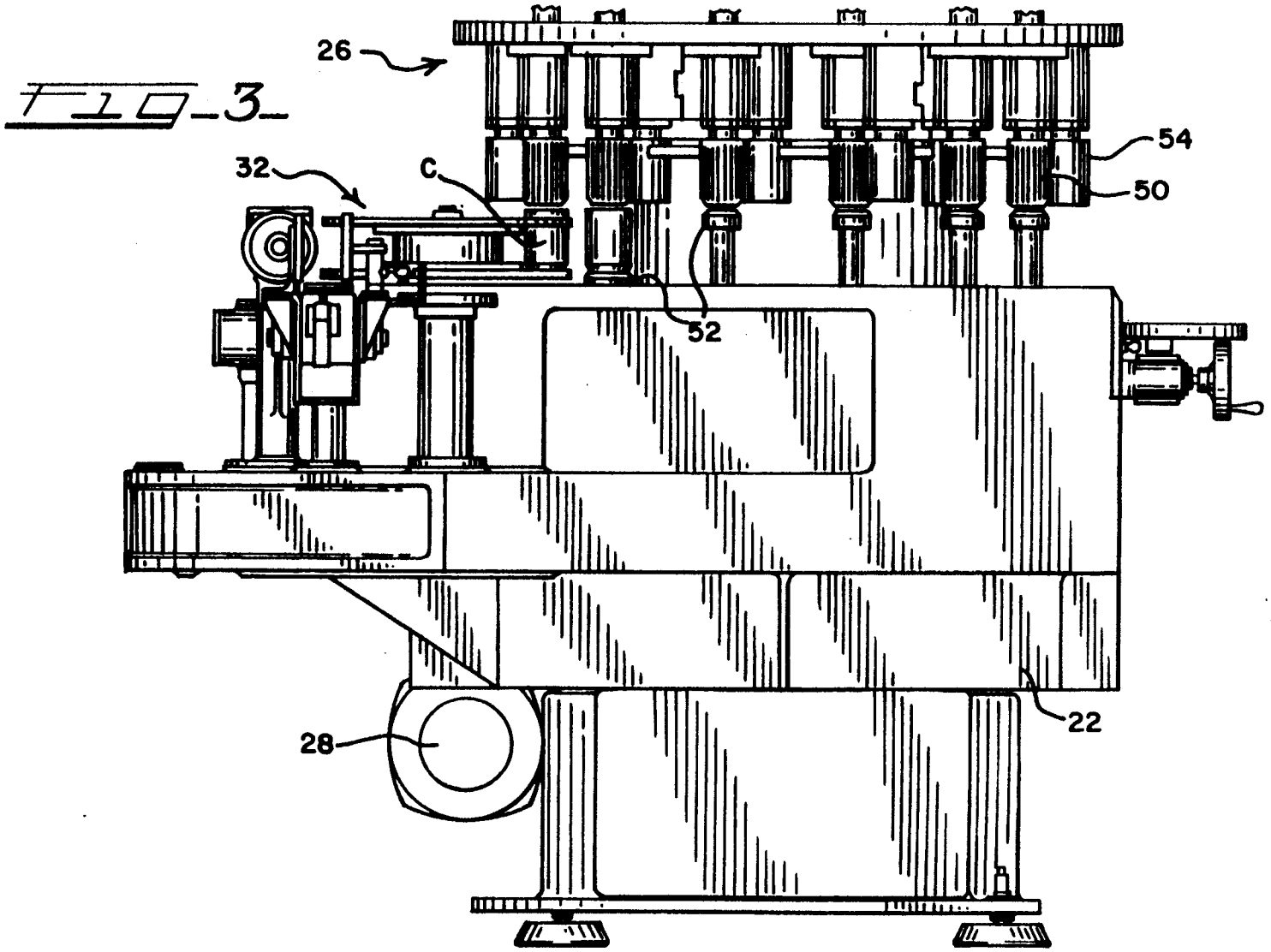
FIG. 3 is a side view of the apparatus as viewed along line 3—3 of FIG. 2.

As shown in FIGS. 1 and 2, each station 30 incorporates a support mandrel 50, a platform 52 mounted on a piston rod 53 and an impression mandrel 54 (FIG. 2). Platform 52 is supported on piston rod 53 which is vertically reciprocated in an opening in the turret 26 through a known type of cam mechanism (not shown). The cam mechanism for moving the platforms 52 between the lowered and the raised positions may be of the type shown in U.S. Pat. No 4,519,232, incorporated herein by reference.

Thus, a container C is delivered from feed mechanism 32 to a platform 56 while the platform is in the lowered position, shown to the left of the extended platform in FIG. 2, and the platform is raised through a cam drive mechanism to introduce or load the container onto the support mandrel 50. The loading mechanism 52, 53 may incorporate a vacuum source (not shown) for holding the container on the platform 52 prior to being received onto the support mandrel 50.

The support mandrel 50 and impression mandrel 54 are continuously driven in synchronized manner through a common drive mechanism (FIG. 1) which includes a central fixed drive gear 60 that is supported on the upper end of the stationary column 24 and is in mesh with a plurality of driven gears 62. The driven gears 62 are in driving engagement with the gears 64 that are mounted on support shafts 66 which have the support mandrels 50 mounted on the lower end thereof. In addition, each driven gear 64 is in mesh with an associated gear 70 mounted on a support shaft 72 which supports an impression mandrel 54. Thus, by proper selection of gear diameters and ratios, the shafts 64 and 72 are driven at a common speed and thus drive the mandrels 50 and 54 at a common speed, for a purpose to be explained later.

According to one aspect of the invention, the respective impression mandrels are designed to be moved into and out of pressure engagement with the support mandrels 50, while the turret 26 is rotating and the mandrels 50, 54 are being positively driven to deform the container C between the respective mandrels, as will be described later.

Figure 4:
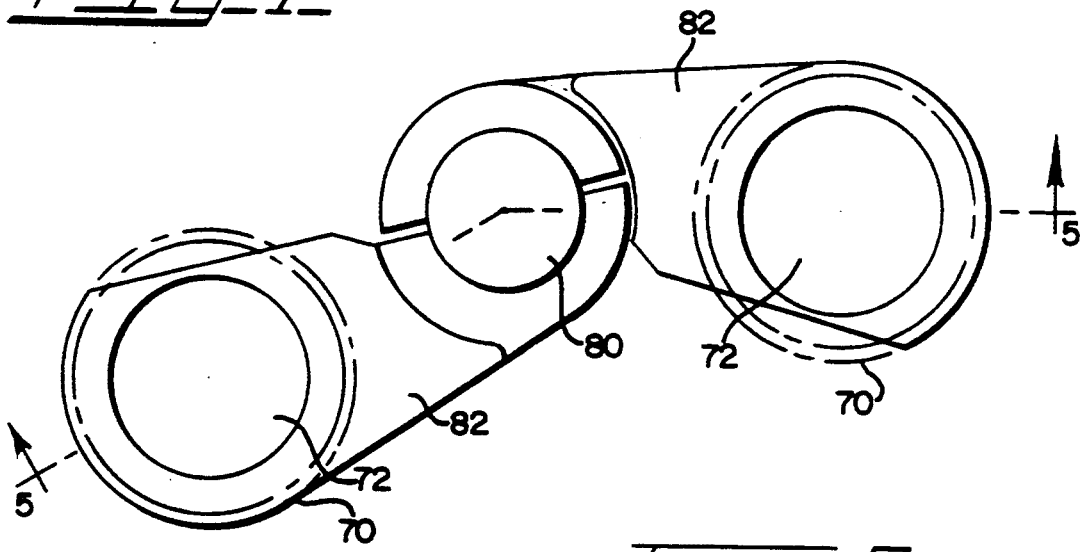
FIG. 4 is a fragmentary plan view of a pair of impression mandrels foxing part of the apparatus of FIG. 3.
Figure 5:
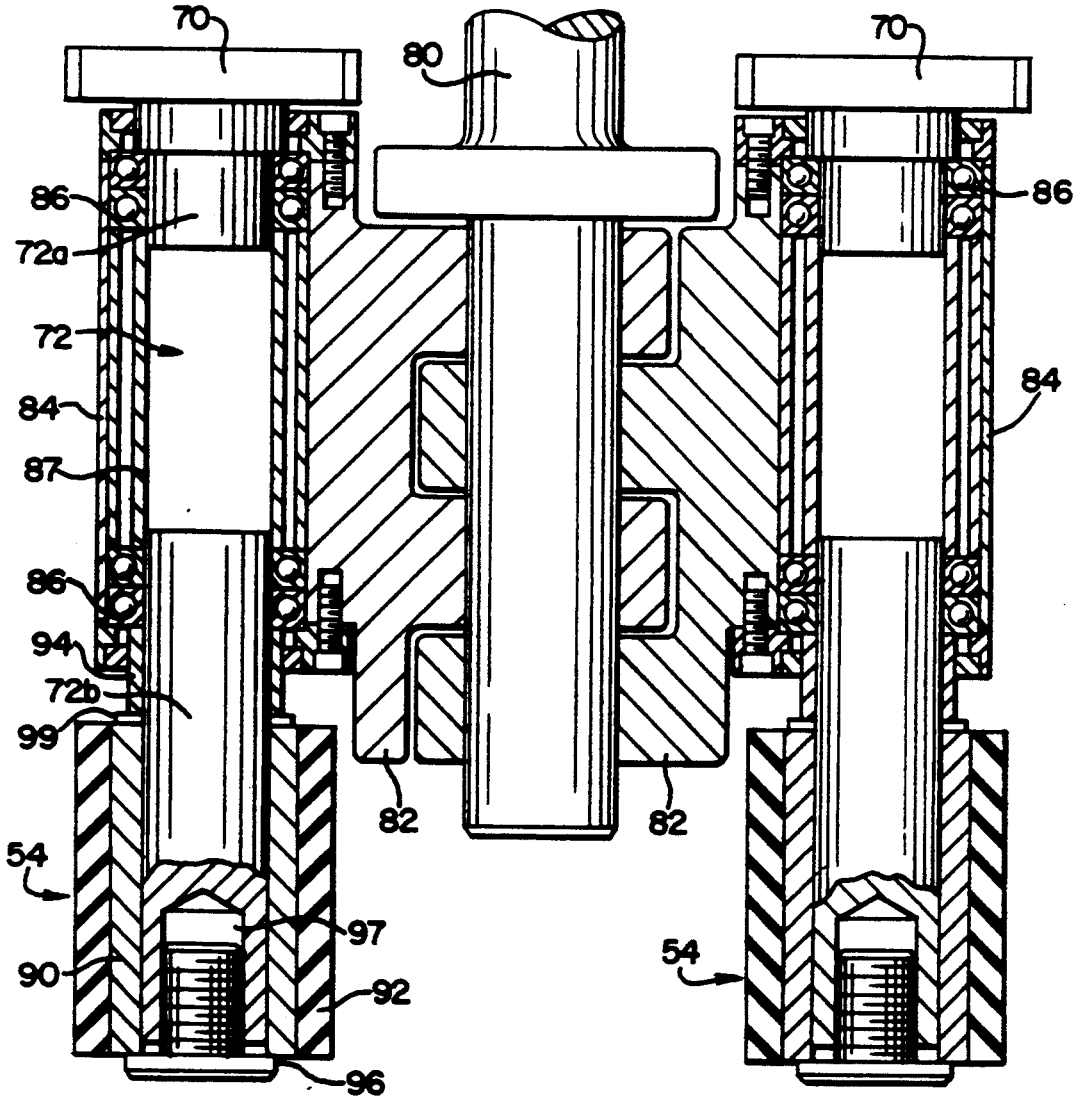
FIG. 5 is a cross-sectional view as viewed along line 5—5 of FIG. 4.

According to one aspect of the invention, a pair of adjacent impression mandrels 54 are supported on a common support mechanism and are moved simultaneously by a simplified cam drive mechanism, which will now be described, with particular reference to FIGS. 4 and 5.

As shown therein, the support mechanism for the impression mandrels 54 includes a support shaft 80 that is mounted on turret 26 between an adjacent pair of processing stations 30. The support shaft 80 has a pair of arms 82 extending therefrom and the arms are secured to the support shaft 80 through suitable set screws (not shown) at a desired angular relation, as will be explained later.

Each of the arms 82 has a hollow support sleeve 84 secured to the outer free end thereof, which in turn supports shaft 72 having the impression mandrel 54 supported at its lower end. Preferably the shafts 72 are segmented and include an upper segment **72*a* that has gear 70 affixed thereto and a lower portion 72*b* which supports the mandrel 54. Suitable bearings 86 are interposed between the shafts 72 and the hollow support members 84 with spacer sleeves 87 interposed therebetween, as shown in FIG. 5**.

Each impression mandrel 54 preferably includes a center rigid core 90 which supports a deformable or compressible outer member 92 that is preferably formed of a polyurethane material or suitable equivalent.

In one embodiment of the invention, the impression mandrel 54 is mounted on lower support shaft portion **72*b* through a frictional drive arrangement to accommodate a controlled velocity or speed differential between the impression mandrel and the support mandrel rather than the common or uniform speed described above. As shown in FIG. 5, the lower shaft portion 72*b* has a spacer collar 94 that is interposed between bearings 86 and the rigid core 90 and the impression mandrel is forced against the collar 94 through a threaded fastener 96 that is received into a threaded opening 97 formed in the lower end of the lower support shaft 72*b*. A spring washer 99 is interposed between the upper end of the core 90 and the lower edge of collar 94**.

Thus, the amount of frictional drag created between the hollow core 90 and the shaft **72*b* can be accurately controlled by proper torque applied to the fastener 96, which will compress spring washer 99 to produce the desired frictional drag. This will provide a controlled differential speed between the positively gear driven support mandrel 52 and the impression mandrel 54. Additional frictional force can be produced by proper dimensioning of the shaft 72*b* with respect to the core 90**.

Figure 12:
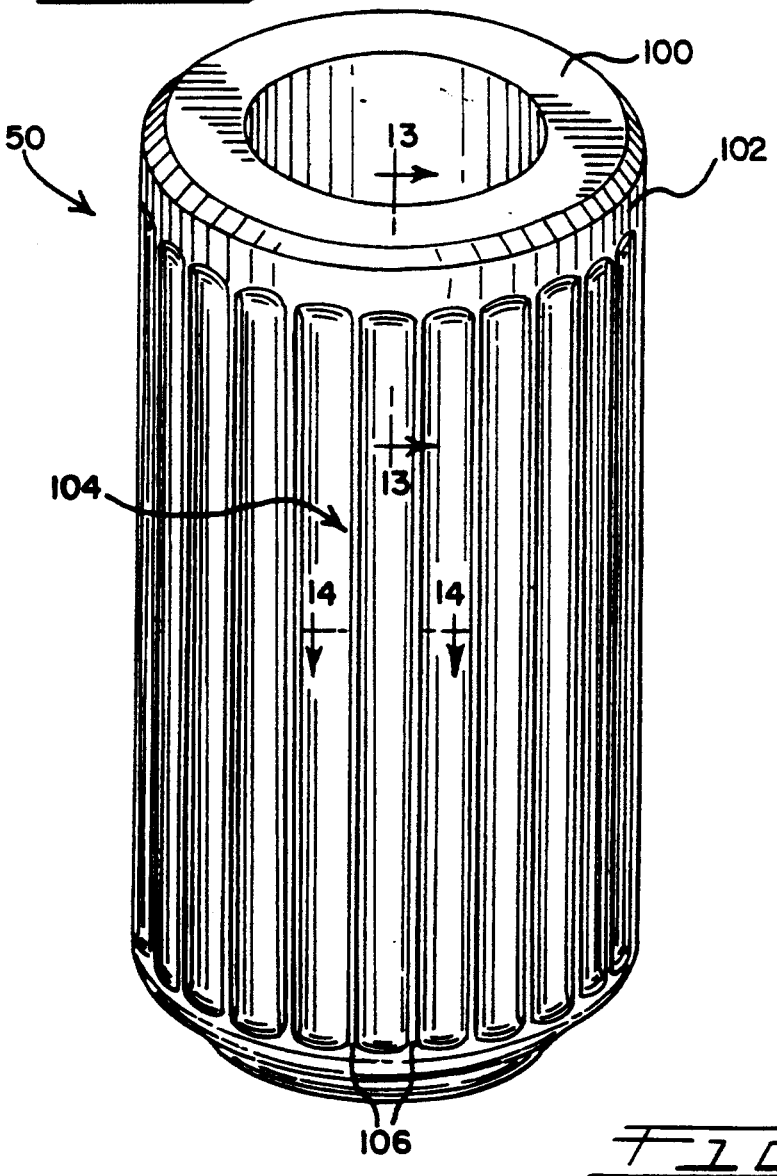
FIG. 12 is a perspective view of the foxing mandrel.
Figure 14:
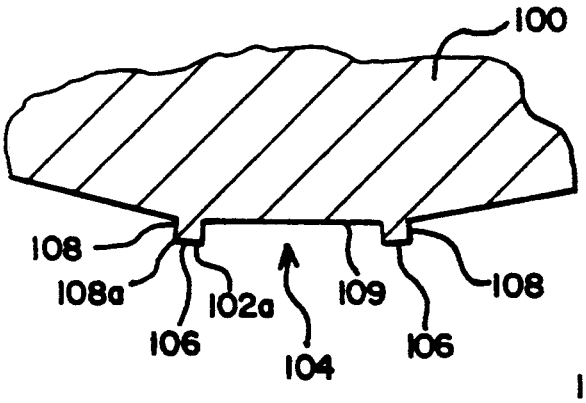
Figure 13:
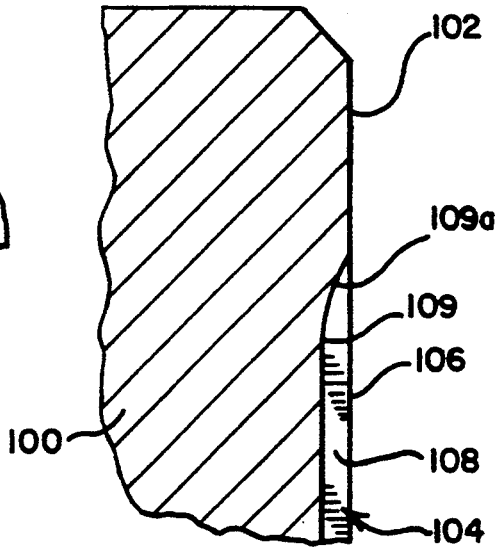
FIG. 13 is a cross-sectional view as viewed along line 13—13 of FIG. 12; and, FIG. 14 is a cross-sectional view as viewed along line 14—14 of FIG. 12.

According to the primary aspect of the present invention, the support mandrel is configured and designed such that the container side wall is deformed in the support mandrel by the pressure of the impression mandrel to produce a plurality of chordal segments deformed inwardly from the original side wall of the container. Thus, as shown in FIGS. 12, 13 and 14, the support mandrel 50 includes a hollow circular core 100 which has a circular peripheral surface 102 that has a diameter substantially equal to the internal diameter of the container side wall. A plurality of circumferentially-spaced axially-extending pockets 104 are formed in the surface 102 of the support mandrel 50, such as by machining, after the mandrel has been finished to a cylindrical configuration conforming to the inner diameter of the container.

More specifically, the respective pockets 104 are formed by machining a segment from the surface of the support mandrel 50 between adjacent pairs of lands 106. Lands 106 have an outer surface 102*a* conforming to the radius of surface 102 of the core 100 and have flat side walls 108 interconnected by a flat bottom wall 109 that defines a chordal surface 104*a* between lands 106. The flat side walls 108, Which preferably extend radially from the axis of the core 100, intersect with surfaces 102*a* to form sharp edges 108*a*. As more clearly shown in FIG. 14, the cross-segment configuration of each land is approximately square and has a depth of approximately 0.030 inch and a width of approximately 0.030 inch In the exemplary embodiment, the support mandrel is designed to produce a can or container that has what may be referred to as 30 equally spaced flutes formed in the side wall of the container, as more clearly shown in FIG. 11.

For such an embodiment, the center-to-center spacing between an adjacent pair of lands 106 is about 12° and thus the depth of the pocket 104 is approximately 0.030 inch. As shown in FIG. 13, the opposite ends of the pockets 104, more specifically the bottom walls 109, are flared at 109*a* to merge through a smooth transition with the outer surface 102 of the support mandrel 50. The function and operation of the pockets 104 will be described in detail in connection with the operation of the apparatus that will be described later.

As explained more fully above, each impression mandrel 54 cooperates with the support mandrel 50 to deform the side wall of the container to a plurality of what is referred to as "chordal segments" interposed between arcuate segments having a diameter equal to the diameter of the side wall of the container. For this purpose, the impression mandrel 54 is supported for movement into and out of engagement with the can body on the support mandrel 50 during rotation of the turret 26 about the support column 24.

For this purpose (FIG. 1), the upper end of the column 24 has a stationary cam 110 affixed thereto which has a peripheral camming surface 112. The peripheral camming surface 112 cooperates with a cam follower 114 that is mounted on an arm 116 which is secured to the upper end of the support shaft 80. Thus, rotation of the turret 26 will cause the cam followers to follow the cam surface 114 and will pivot the support shaft 80 about its support axis. This pivots the support arms 82 along with the impression mandrels 54 into and out of pressure engagement with a can body C on the associated support mandrels 50 during each cycle of rotation of the turret.

The operation of the apparatus will now be summarized. Open-topped drawn and ironed containers are delivered from conveyor 40 to the stations 30 by infeed mechanism 32. The containers are received on platforms 52 and are loaded onto support mandrels 50 at each station while the turret 26 and support mandrels 50 are rotating.

The impression mandrels 54, which are positively driven through the support mandrels, are then cammed into pressure contact by pivoting shafts 80 through cam 112 and arms 116 to engage the can body and deform the container side wall. During this deformation, crease lines are formed in the container side wall by the sharp edges 108*a* of the lands or ribs 106 end chordal segments are formed between the crease lines.

The amount of deformation of the chordal segments is controlled by varying the engagement pressure between the impression mandrel and the support mandrel. This in turn is controlled by angular adjustment of the arms 82 on shaft 80. Since the effective diameter of the compressible outer members 92 of impression mandrels 54 varies with the pressure between the mandrels, the frictional drive between shaft 72 and mandrel 54, more specifically spring washer 99 and core 90, will adjust the peripheral speed of the impression mandrel with the peripheral speed of support mandrel so that these speeds are synchronized.

Figure 11:
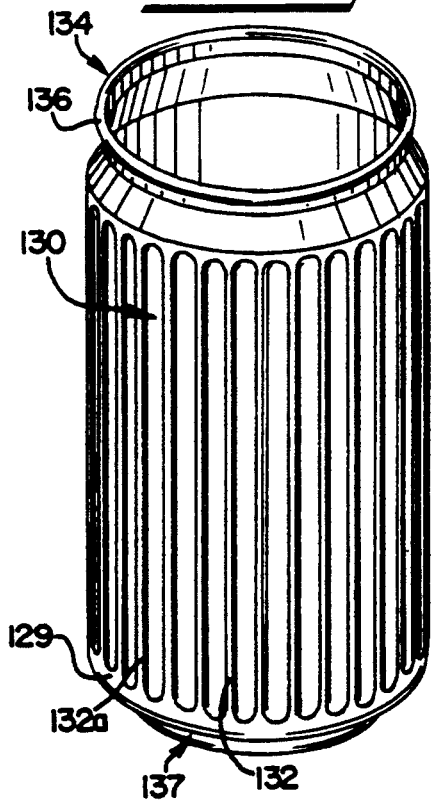
FIG. 11 is a perspective view of the finished container after the necking and flanging operations.

The deformed side wall 129 of the container thus takes a configuration that is illustrated in FIG. 11 in which a plurality of deformed segments 130 are defined between adjacent lands or arcuate segments 132. The arcuate segments 132 have a peripheral arcuate configuration that conforms to the arcuate configuration of the container side wall. Opposite edges of the deformed segments 130 are defined by crease lines 132*a* produced by the sharp edges 108*a* of mandrel 150. The container also has a reduced neck 134 and an outwardly-directed flange 136 formed thereon through the die necking process, disclosed in the '839 patent discussed above and a bottom profile referred to as an ANC-1A bottom profile, illustrated in the above '582 patent, both incorporated herein by reference.

The finished drawn and ironed container shown in FIG. 11 fluted with the above apparatus showed enhanced physical properties hereto not experienced in conventional drawn and ironed containers that are presently being utilized on a commercial scale. In fact, containers incorporating the fluted side wall exhibit significantly greater crush strength than identical fluted containers without the fluted side wall. Moreover, these containers were formed from reduced thickness stock material or discs having the same cut edge diameter as prior discs.

In comparison of crush strength, identical fluted containers formed from an aluminum stock material or disc having a thickness of 0.0119 inch to a reduced side wall having a thickness of approximately 0.0045 inch were compared with unfluted side wall (round) containers exhibited the following crush characteristics.

TABLE 1

| | Empty Can Crush Strength (lbs.) | | | |
|---|---|---|---|---|
| | | | Thickness Side Wall | |
| | Round Std. Neck | Fluted Std. N. | Round | Fluted |
| Min. | 298 | 335 | 0.0044 | 0.0044 |
| Max. | 337 | 337 | 0.0045 | 0.0046 |
| Avg. | 318 | 336 | 0.0044 | 0.0045 |

The above data clearly demonstrates that the fluted containers exhibited extremely uniform crush strength that averaged 336 pounds, which is significantly greater than the required minimum of 250 pounds. It was also determined that identical unfluted round side-walled containers crushed onto the lower body while the fluted containers failed by bulging out just above the juncture between the side wall and the bottom profile. While not fully explored, it appears that the flared end of the chordal segment 130 adjacent the juncture with the integral bottom wall enhances crush strength for the containers.

These containers were formed to the following parameters:

FLUTED CAN CAPACITY
206/211 × 413 ANC-1A DIE NECKED "A" NECK

| Can Description | Can Height | Dome Depth | Head Space | Overflow Capacity |
|---|---|---|---|---|
| Round Std. Neck | 4.818 | .381 | .499 | 13.17 |
| Fluted Std. Neck | 4.814 | .380 | .475 | 13.15 |

Identical containers were also subjected to a single can drop test after having been filled with commercial soft drink beverage product. The single can bottom drop test is performed to evaluate bottom wall resistance to dome eversion when cans are dropped onto the integral bottom end wall. The testing apparatus consists of a four-foot tube securely attached to a solid steel base and the cans are dropped from various heights until dome eversion occurs.

Twenty-four cans, fluted and unfluted (control) cans were drop-tested and the control cans showed a "rocker" failure at about a twenty-nine inch drop, while the fluted cans did not experience any "rocker" failures at the four-foot maximum drop. A "rocker" failure occurs when the profiled bottom wall of the containers everts to the point where the container is no longer stable when placed on a flat surface. These containers were filled with Classic Coke® soft drink and were dropped onto a 150 lb. "B" flute test board at a temperature of 76° F.

Fluted and control cans were filled with Diet-Caffeine Free-Coke and were drop-tested onto a Mead 0.024 inch chipboard overwrap at 76° F. The control containers experienced "rocker" failure at about an 8 inch drop while the fluted containers experienced "rocker" failure at about a 23 inch drop.

Thus, it has been conclusively established that the fluted containers have significantly improved crush resistance, which has minimal variation from container to container. Also, fluted containers have significantly greater resistance to dome eversion, i.e., they are more capable of absorbing hydraulic shock.

While the parameters have not been fully explored, it is believed that the fluted containers also improve filled container buckle resistance when products are subjected to elevated temperatures during storage in hot climates. Also, the fluted containers eliminate "gull winging", which can lead to crushed containers during filling and end seaming operations. "Gull winging" is a slight imperfection in the container side wall which produces a wave in the side wall during the container-forming operation.

Another factor that appears to be of significant importance is the length of the flute in the side wall and its relation to the juncture between the side wall and the tapered neck, as well as the integral bottom wall. Opposite ends of the flutes, i.e., the chordal panel segments, should be as close as possible to the junctures but should not intersect with the junctures. It has been determined that a spacing of about 0.050 inch of the ends of the flutes from the junctures produces an ideal container. However, these dimensions can readily be varied independently or jointly without any significant departure from the spirit of the invention.

The above tests also show that the containers exhibits significantly greater resistance to internal pressure without any damage to the container. The flutes incorporated into the side wall have the ability to absorb a significantly greater amount of hydraulic shock when the containers were dropped in standard drop tests. It is believed that the internal pressure build-up will have a tendency for the chordal portions between the lands of the side wall to revert back to the general arcuate configuration of the container side wall and thereby provide greater resistance to pressure increase without any damage to the container side wall. It has also been determined that the internal pressure thereof, because of the flutes, can be greater without any significant effect on the domed end wall of the container, i.e., without any significant degree of container growth or dome reversal.

Actual tests have shown that the stock material metal thickness of the discs for forming the aluminum drawn and ironed containers can be further reduced without any sacrifice in strength characteristics of the container. For example, tests have shown that the stock material can readily be reduced to a thickness of 0.0118 inch and possibly significantly below that level without sacrificing the strength characteristics for the container.

While the parameters have not been fully explored, it is believed that the greater the length of the flutes between the domed end wall and the reduced diameter neck, the better performance characteristics can be expected. Thus, it is anticipated that the arcuate ends of the pockets 130 formed in the side wall of the container merge with the side wall just inwardly of the crease line, which defines the demarcation of the side wall into the reduced neck 134, as well as the bottom 137.

Additional tests were conducted to confirm the feasibility of reducing side wall thickness in containers while maintaining minimum performance characteristics for fluted containers.

These tests were conducted to actually determine the amount of abuse that the side wall of the container could absorb before damage occurred to the side wall without regard to any rolling or disfiguration of the dome or any collapsing in the neck area of the container.

Drawn and ironed aluminum containers were formed on commercial D&I machinery from discs of 0.0120 aluminum stock. These containers were conventional twelve-ounce containers having a 211-side wall diameter and a 413-height with a reduced 206-neck for a 206-end. The container side walls were reduced to an average thickness of 0.0039 inch. Control containers were tested and compared with containers that had been fluted in accordance with the teachings of the present invention.

These containers produced the following results for crush strength in pounds:

| | Control Container | | Fluted Body | |
|---|---|---|---|---|
| | Vertical Crush | Offset Crush | Vertical Crush | Offset Crush |
| Min. | 214 | 76 | 272 | 74 |
| Max. | 293 | 80 | 313 | 76 |
| Avg. | 249 | 78 | 299 | 76 |

These fluted containers also showed an average elongation (container growth) at peak load of about 0.04 inch, while the control containers showed an average elongation of 0.03 inch.

While the dome depth for these containers was below the acceptable minimum of 0.380 inch, i.e., dome depth was about 0.363 inch, these containers were tested to determine container growth in relation to internal pressure and minimum acceptable buckle pressure (psig). The following test results were recorded:

| Body Variable | Sample | Dome Growth and Buckle: Dome Depth 75 | 80 | Dome Depth 82 | 85 | After 90 | | PSIG Buckle | |
|---|---|---|---|---|---|---|---|---|---|
| Fluted | 1 | .363 | | .006 | .011 | .030 | .048 | .065 | 94 |
| | 2 | .363 | | — | — | — | .049 | .069 | 95 |
| Round | 1 | .363 | | .004 | .009 | .028 | .047 | .063 | 95 |
| | 2 | .363 | | — | — | — | .048 | .066 | 95 |
| AIM | | .380 +/−.0004 (ANC-1A) | | — | — | — | .045 MAX | .064 MAX | 90 MIN |

These containers exhibited unacceptable growth due to worn tooling and/or thermal stress. However, these test results show that fluting the side wall will allow side wall thickness reduction without sacrificing performance characteristics, such as crush strength, container growth, or resistance to buckling.

Figure 9:
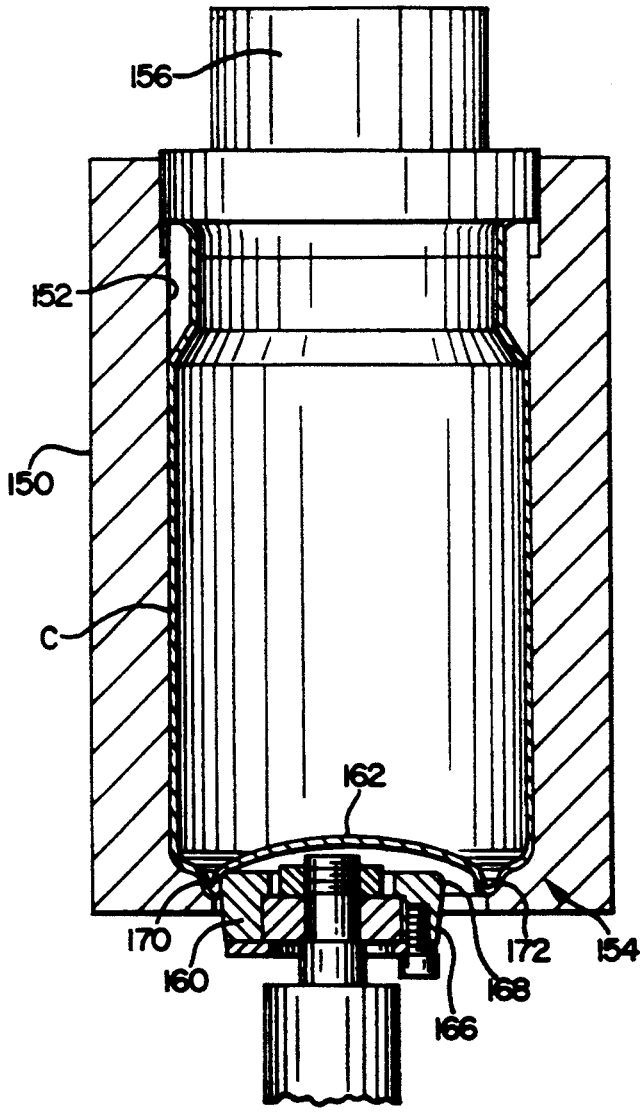
FIG. 9 is a fragmentary cross-sectional view showing the apparatus utilized for reforming the container bottom wall.
Figure 10:
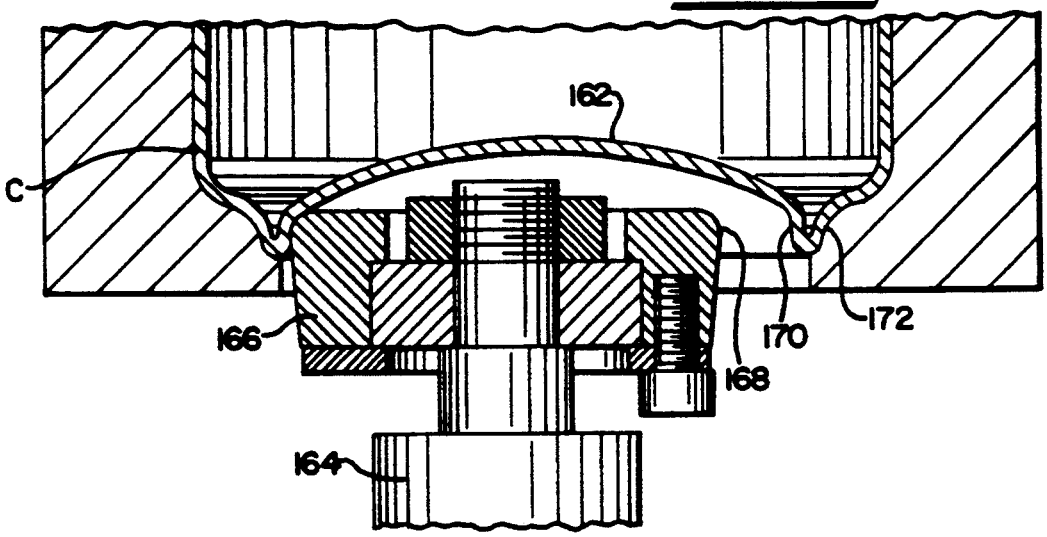
FIG. 10 is an enlarged fragmentary cross-sectional view similar to FIG. 9.

According to one further aspect of the invention, the container that has been formed in accordance with the teachings above and is disclosed in FIG. 11 has even more significantly improved performance characteristics by reforming the bottom end wall of the container from the initial configuration, as disclosed in the above-mentioned '582 patent. Thus, as shown in FIGS. 9 and 10, after the fluted container has been necked and flanged and has been internally spray coated and externally printed, the bottom profile, more specifically the countersink or chime area of the bottom wall, is reshaped by reforming the inner wall of the countersink to further improve buckle resistance and decrease can growth. This particular process would also allow further reduction in stock metal thickness without any change in the cut edge diameter of the initial disc.

Thus, as shown in FIG. 9, the finished drawn and ironed container of FIG. 11 is supported in a suitable jig 150 that has an internal opening 152 which corresponds to the outer peripheral diameter of the container C. The jig has a lower profile portion 154 that conforms to the countersink wall portion of the bottom wall of the container, as originally formed in accordance with the process disclosed in the '582 patent.

A plug 156 is inserted into the upper end of the opening and securely held in the top of the container. The bottom peripheral profile 154 of the jig 150 is in extended contact with the container bottom 137. A reforming roller 160 is brought into engagement with the outside of the domed end 162 of the container and is supported on a shaft 164 that is designed to be rotated along an arcuate path around the center axis for the container C. The roller has a peripheral configuration 166 which defines a substantially vertical upwardly and outwardly tapered wall having a generally arcuate upper portion 168 so that the inner wall 170 of the countersink is reformed to a more vertical profile while the dome 162 is stretched to a small degree. The outer wall 172 is held to its original configuration. Alternatively, the outer wall could also be reformed with the inner wall.

It has been found that this reforming operation significantly improves buckle resistance and decreases the amount of can growth, i.e., the amount that the bottom end wall is elongated when pressure is applied internally of the container.

Thus, in summary, the container produced according to the method and apparatus of the present invention has been found to have significantly greater column strength, i.e., resistance to crushing by vertical loads applied to the container side wall, has significantly less container growth during internal pressurization, and also has improved buckle resistance. The container constructed in accordance with the present invention has been found to be capable of being produced from stock flat disc material having a significantly reduced thickness.

While the specific embodiments have been illustrated and described, numerous modifications come to mind without significantly departing from the spirit of the invention and the scope of protection is only limited by the scope of the accompanying claims.

We claim:

1. A method of processing a drawn and ironed open-ended container having a dome-shaped bottom wall merging with a cylindrical side wall through a generally U-shaped annular support member including a rotating turret (26) having a plurality of peripheral stations (30) with each station having a rotation rigid mandrel (50) and loading means (52, 53) for loading a container onto said mandrel, said mandrel having a peripheral surface (102) conforming generally to an inner diameter of said container and having spaced pockets (104) formed therein, each station including an impression mandrel (54) associated therewith, the steps of introducing containers to said loading means at each station and introducing said container onto said rigid mandrel, moving said impression mandrel into pressure engagement with said rigid mandrel to grip said container therebetween, driving said rigid mandrels and said impression mandrels to deform said side walls of said containers into said pockets and providing a support (80, 82) between an adjacent pair of stations with an adjacent pair of impression mandrels supported thereon, and pivoting said support to simultaneously produce pressure engagement between said adjacent pair of impression mandrels and an adjacent pair of rigid mandrels.

2. A method as defined in claim 1, in which said pockets extend axially of said rigid mandrel and have opposed edge **(122*a*)**, including the further step of deforming said side wall into said pockets to produce crease lines along said opposed edges and generally chordal segments between said edges.

3. A method as defined in claim 1, in which said U-shaped annular support member includes an outer wall and an inner wall merging with an inwardly-domed center panel, including the further step of reforming said inner wall of said U-shaped annular support member to reshape said inner wall to a more vertical configuration and expand said center panel.

4. Apparatus for processing drawn and ironed containers having a cylindrical side wall integral with a bottom wall that includes a inwardly-domed center panel surrounded by a U-shaped annular support member comprising a turret (26) rotated about a fixed support (24) and having a plurality of peripheral processing stations (30); each processing station including a rigid mandrel (50) rotated about a fixed axis with pockets (104) on the periphery thereof, and means (52, 53) for inserting containers onto said rigid mandrel, each station also including an impression mandrel (54) cooperating with said fixed mandrel; support means (80, 82) on said turret between an adjacent pair of stations, said support means including a support shaft (80) having a pair of support arms (82) extending therefrom with an impression mandrel rotatable on each arm; drive means (110–116) interposed between said fixed support and said support shaft for producing pressure engagement between each rigid mandrel and associated depression mandrel, and synchronized drive means (60, 62, 64, 70) between said fixed support and each mandrel to rotate all of said mandrels at a common speed and deform the side walls of said containers between said mandrels into said pockets.

5. Apparatus as defined in claim 4, further including means (96, 99) for varying the speed of said impression mandrel with respect to said support mandrel as a function of the effective diameter thereof.

6. A method of continuously reshaping open-ended containers having a side wall upstanding from a bottom, said method utilizing a rotating turret (26) having a plurality of stations (30) with each station having a rotating support mandrel (50), and means (52, 53) for loading a container onto said support mandrel, said support mandrel having a peripheral surface (102) adapted to engage an inner side wall surface of said container and having a design (104) formed thereon, each station including an impression mandrel (54) associated therewith, said method comprising:

continuously loading said containers onto said support mandrels;

moving said impression mandrel and said support mandrel relative to each other to grip said container therebetween;

driving said support mandrels and said impression mandrels to deform said side walls of said containers into said design; and providing a support (80, 82) between an adjacent pair of said stations, with an adjacent pair of said impression mandrels supported thereon, and pivoting said support to simultaneously produce pressure engagement between said adjacent pair of impression mandrels and an adjacent pair of said support mandrels.

7. The method as defined in claim 6, in which said design comprises spaced pockets extending axially relative to said support mandrel and having opposed edges (122*a*), including the further step of deforming said side wall into said design to produce crease lines along said opposed edges and generally chordal segments between said edges.

8. The method as defined in claim 6, wherein said side wall is generally cylindrical.

9. The method as defined in claim 6, in which said impression mandrels are cammed into pressure engagement with said support mandrels.

10. The method as defined in claim 6, wherein said mandrels are driven synchronously.

11. The method as defined in claim 10, wherein the speed of said support and impression mandrels are automatically adjusted to be synchronous.

12. The method as defined in claim 11, wherein said automatic adjustment is achieved by a frictional drive.

13. The method as defined in claim 12, wherein said support mandrels and said impression mandrels are both driven.

14. The method as defined in claim 13, wherein only one of said mandrels is driven.

15. The method of claim 6, wherein said impression mandrel includes a deformable outer member.

16. The method of claim 6 wherein said support mandrel and said impression mandrel are vertically disposed.

17. An apparatus for continuous reshaping of side walls of containers, comprising a turret (26) rotatable about a fixed support (24) and having a plurality of reshaping stations (30) thereon, each reshaping station including a support mandrel (50), an impression mandrel (54) movable into and outer of engagement with said support mandrel, loading means (52, 53) for introducing a container onto said support mandrel, said support mandrel including a peripheral surface (102) adapted to engage an inner side wall surface of said container, and having a design (104) formed thereon, and means to automatically adjust the synchronous rotation of said support and impression mandrel, wherein said automatic adjustment is achieved by a frictional drive.

18. The apparatus of claim 17 wherein said support mandrel and said impression mandrel are vertically disposed.

19. The apparatus of claim 17, including means to automatically adjust the synchronous rotation of said support and impression mandrel.

20. The apparatus of claim 17, wherein both of said support and impression mandrels are driven.

21. The apparatus of claim 17, wherein only one of said support and impression mandrels is driven.

22. A continuous method of reshaping a plurality of containers, each of said containers having a side wall, said method comprising:

continuously introducing said containers to a loading means at a station;

placing each of said containers onto a support mandrel having a design formed on a peripheral surface;

moving an impression mandrel into pressure engagement with said support mandrel to grip said container therebetween; and driving said support mandrel and said impression mandrel together to deform said side wall of each of said containers into said design, wherein said impression mandrel includes frictional drive means for providing a controlled differential speed between said support mandrel and said impression mandrel.

23. The method of claim 22, wherein said support and impression mandrels are continuously rotated upon a turret.

24. The method of claim 22, wherein said impression mandrel includes a deformable outer member.

25. The method of claim 22 wherein said support mandrel and said impression mandrel are vertically disposed.

26. Apparatus for continuously processing containers, comprising:

a turret continuously rotated about a fixed support and having a plurality of peripheral reshaping stations, each of said reshaping stations including a support mandrel having a design formed on a peripheral surface;

means for inserting containers onto said support mandrel;

an impression mandrel cooperating with said mandrel;

support means on said turret between an adjacent pair of stations, said support means including a support shaft having a pair of support arms extending therefrom with an impression mandrel rotatable on each of said arms;

drive means for producing pressure engagement between each support mandrel and associated impression mandrel; and frictional drive means for said impression mandrel to provide a controlled differential speed between said support mandrel and said impression mandrel.

27. The apparatus of claim 26, wherein said design comprises a plurality of pockets.

* * * * *